US005360180A

United States Patent [19]

Welp et al.

[11] Patent Number: 5,360,180

[45] Date of Patent: Nov. 1, 1994

[54] ROLL-SUPPORT SYSTEM FOR PAPER-WINDING MACHINE

[75] Inventors: Ewald G. Welp, Erkrath; Erhard Milke, Langenfeld; Reinhard Hehner, Haan, all of Germany

[73] Assignee: Jagenberg Aktiengesellschaft, Dusseldorf, Germany

[21] Appl. No.: 77,208

[22] Filed: Jun. 14, 1993

[30] Foreign Application Priority Data

Jun. 13, 1992 [DE] Germany ..... 4219485

[51] Int. Cl.[5] ..... B65H 18/16; B65H 19/30

[52] U.S. Cl. ..... 242/530.4; 242/541; 242/908; 242/533

[58] Field of Search ..... 242/56.4, 56.5, 56.2, 242/56.9, 65, 56.6

[56] References Cited

U.S. PATENT DOCUMENTS 4,749,140 6/1988 Ruff ..... 242/56.4
5,000,395 3/1991 Welp et al. ..... 242/56.4

FOREIGN PATENT DOCUMENTS 4201815 7/1993 Germany .

*Primary Examiner*—John M. Jillions
*Attorney, Agent, or Firm*—Herbert Dubno; Andrew Wilford

[57] ABSTRACT

A relatively wide strip of paper is slitted longitudinally into a plurality of strips that are fed to a rotating relatively wide main roller. A plurality of pairs of support heads are arranged in two rows extending along the main roller with the rows spaced angularly from each other. Each pair of support heads is spaced in the respective row axially from the other support heads of the respective row and each pair is adapted to engage in an end of a roll core about which a respective one of the strips is wound. A drive rotates the main roller and thereby winds the strips up on the respective roll cores. Two respective vertically movable unloading beams extend axially along the main roller underneath the respective rows of support heads substantially the full length of the main roller. Respective guides extend along each of the beams substantially the full length of the main roller and respective carriages associated with the holder pairs can travel along the guides of the respective beams. A respective blower box on each of the carriages has an upwardly open mouth snugly engageable with the roll held in the respective pair of holders. Each such box can be individually raised to fit the respective mouth to the respective roll. Air is ejected from the mouths of the blower boxes to at least partially support the respective rolls via respective air cushions on the respective blower boxes.

5 Claims, 3 Drawing Sheets

ROLL-SUPPORT SYSTEM FOR PAPER-WINDING MACHINE

FIELD OF THE INVENTION

The present invention relates to a machine used to cut a wide strip of paper into a plurality of parallel strips and to wind each of these strips into a respective roll. More particularly this invention concerns a system for supporting the rolls in and unloading them from such a machine.

BACKGROUND OF THE INVENTION

As described in German patent application P 4,201,815 it is known to form rolls of paper, which term is here intended to cover all forms of paper, cardboard, and like material, in an apparatus having a relatively wide main roller rotatable about and centered on a main axis and a plurality of pairs of support heads arranged in two rows extending along the main roller with the rows spaced angularly from each other relative to the main axis. Each pair of support heads is spaced in the respective row axially from the other support heads of the respective row and each pair of support heads is adapted to engage in an end of a roll core about which a respective narrow strip is wound. Two respective beams extend axially along the main roller underneath the respective rows of support heads substantially the full length of the main roller. A respective blower box provided for each roll has an upwardly open mouth snugly engageable with the roll held in the respective pair of holders.

Such a machine is used to make rolls by first longitudinally slitting a wide paper strip into relatively narrow strips and feeding same to the main roller with the strips axially closely juxtaposed while rotating the main roller to wind the strips up on the respective roll cores. The blower boxes are lifted up to fit the respective mouths to the respective roll and air is ejected from the mouths of the blower boxes to at least partially support the respective rolls via respective air cushions on the respective blower boxes, thereby relieving the holders and the main roller of some of this load. When each narrow roll is complete, it is unloaded by releasing it from the holders and then lowering the beams and the blower boxes carried thereby. Once down generally at floor level a crane or special-duty fork lift can pick off and carry away the finished narrow rolls.

Such an apparatus is fairly complex in construction and operation.

OBJECTS OF THE INVENTION

It is therefore an object of the present invention to provide an improved system for making narrow rolls.

Another object is the provision of such an improved system for making narrow rolls which overcomes the above-given disadvantages, that is which is substantially simpler than the prior-art systems.

A further object is to provide an improved method of operating such a machine.

SUMMARY OF THE INVENTION

An apparatus for making a plurality of relatively narrow rolls of paper from a relatively wide strip of paper has according to the invention a relatively wide main roller rotatable about and centered on a main axis, a unit for longitudinally slitting the wide paper strip into relatively narrow strips of papers and for feeding same to the main roller with the strips axially closely juxtaposed, and a plurality of pairs of support heads arranged in two rows extending along the main roller with the rows spaced angularly from each other relative to the main axis. Each pair of support heads is spaced in the respective row axially from the other support heads of the respective row and each pair of support heads is adapted to engage in an end of a roll core about which a respective one of the strips is wound. A drive rotates the main roller and thereby winds the strips up on the respective roll cores. Two respective unloading beams extending axially along the main roller underneath the respective rows of support heads substantially the full length of the main roller and can be raised and lowered. Respective guides extend along each of the beams substantially the full length of the main roller and respective carriages associated with the holder pairs can travel along the guides of the respective beams. A respective blower box on each of the carriages has an upwardly open mouth snugly engageable with the roll held in the respective pair of holders. Each such box can be raised to fit the respective mouth to the respective roll. Air is ejected from the mouths of the blower boxes to at least partially support the respective rolls via respective air cushions on the respective blower boxes.

According to the invention the blower boxes are movable transversely of the respective row and can be raised relative to the beam up to the respective roll. The beam can thus be made very steady and strong to support the rolls when it is subsequently used for unloading. The blower boxes are provided with their own lift units so they can be individually exactly positioned.

In accordance with the invention each of the blower boxes is pivotal on the respective carriage about an axis extending parallel to the main axis. These blower-box axes are closely radially juxtaposed with the main roller. Thus the mouths can be very snugly fitted to the respective rolls for best air-cushion effect.

The guides according to the invention are tracks extending along the respective beams. The carriages are relatively short so that more than one can be used on a fairly large roll.

In accordance with the method of this invention when each narrow roll is complete it is unloaded by first lowering each blower box relative to the respective carriage and thereby disengaging the respective mouths from the respective rolls. Then each blower box is displaced axially into a position out from beneath any of the rolls, normally between the rolls, and the beams are raised to engage same directly against the rolls. Then the rolls are each released from the respective holder pair and the beams are lowered to drop the rolls out from between the respective holder pairs.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
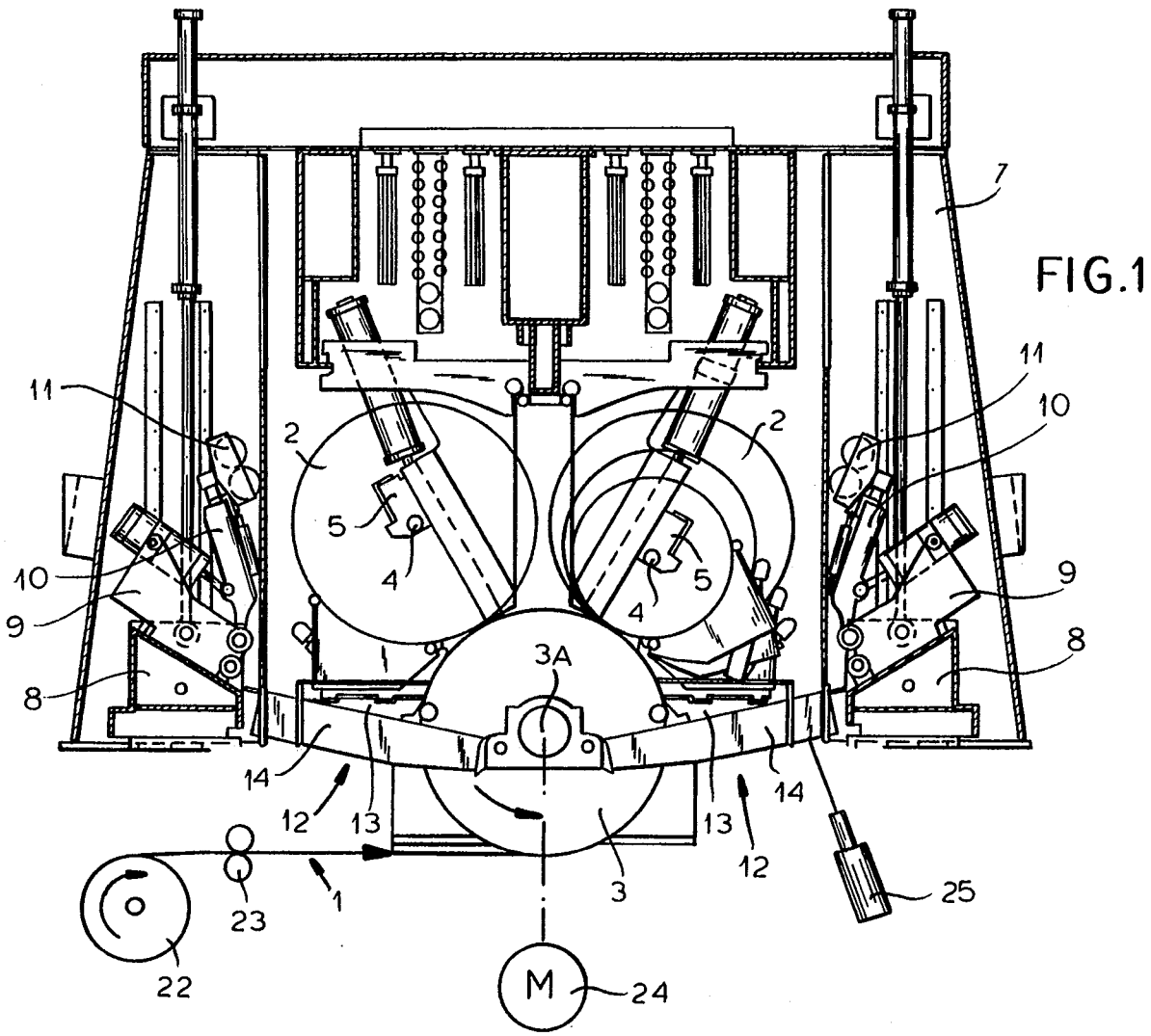
FIG. 1 is a partly diagrammatic sectional end view of the apparatus according to the invention.
Figure 2:
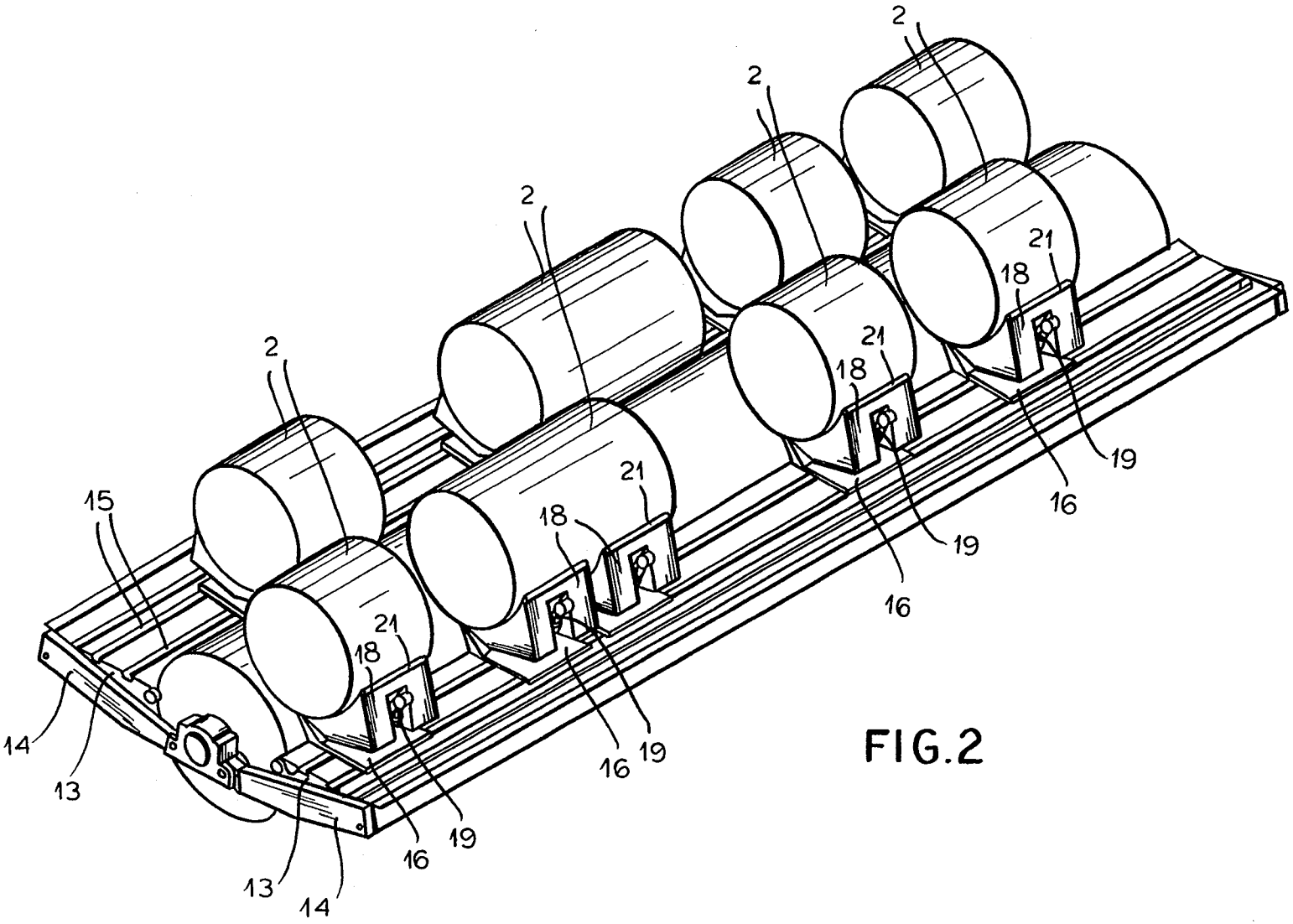
FIG. 2 is a small-scale perspective view of a detail of the invention.

As seen in FIG. 1 a wide paper web 1 is pulled from a supply 22 and cut by a slitter 23 into a plurality (here eight) of narrow strips that are fed tangentially to a main roller 3 rotatable about a horizontal axis 3A and rotated by a motor illustrated schematically at 24. This rotation of the roller 3 winds the individual strips up into rolls 2 supported on cores each held by a pair of holder pins 4 of holders 5 movable radially of the axis 3A on a frame 8 of the machine. The rolls 2 are arranged in two rows and bear radially inward and downward on the roller 3 so that the rotation of the roller 3 rotationally drives the rolls 2 and compresses the strips coiled in them.

Each row of the machine is provided with a raisable beam 8 carrying at each winding station defined by a roll 2 a holddown support 9 carrying an arm 10 whose inner end is provided with rollers 11 that can radially engage and press down a respective one of the rolls 2. This is used only during startup to ensure sufficient friction between the rolls 2 and the roller 3 for good winding and tight compression of the wound-up paper or cardboard.

Figure 3:
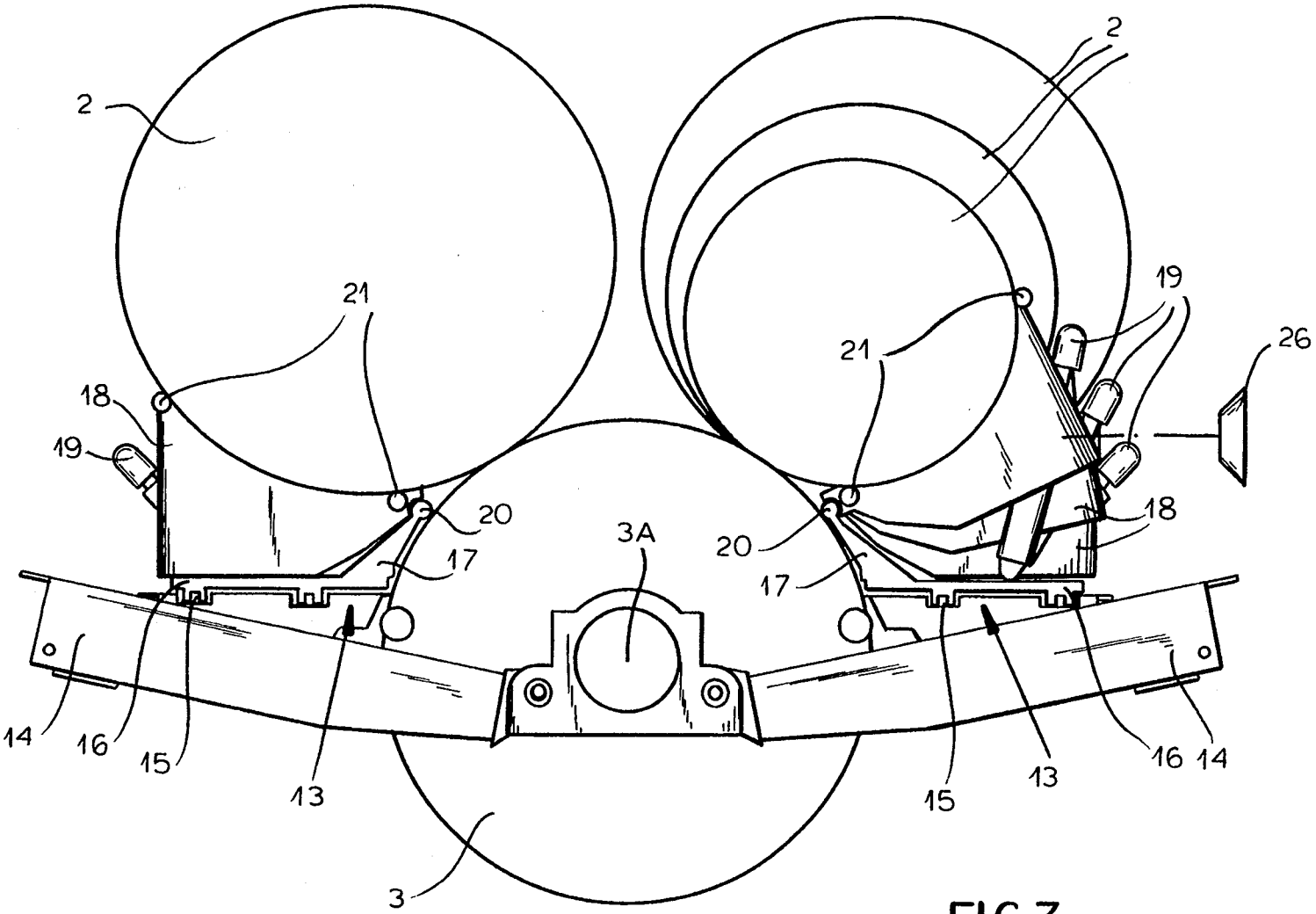
FIG. 3 is a largely schematic end view of a portion of the apparatus.

Each side of the apparatus has an unloading mechanism 12 having a respective rigid unloading beam 13 extending the full length of the roller 3 and carried on arms 14 pivoted near the axis 3A for vertical movement of these beams 13 by means of actuators shown schematically at 25. The upper surface of each of these beams 13 is formed with two full-length grooves each holding a respective track 15 (FIG. 3). Carriages 16 formed as stiff plates ride on these tracks 15, one for each roll 2. Each such carriage 16 has an inner end projection 17 whose inner end forms a pivot 20 for a respective blower box 18 having an upwardly open mouth and an interior that is supplied with air under pressure from a source shown schematically at 26. Cables for moving the carriages 16 and air-supply hoses for the boxes 18 can be recessed in the beams 13.

Each of these blower boxes 18 can be tipped about its respective axis 20, which extends parallel to the axis 3A immediately adjacent the surface of the roller 3, by a respective actuator 19 through at least three positions shown in FIG. 3, to fit rolls 2 of different diameters. Thus as the roll diameter increases, the respective actuator 19 shortens to tip back the box 18.

The mouth of each such box 18 is defined at upper and lower edges by parallel rollers 21 that actually ride on the respective roll 2. The sides are formed with soft seals whose shapes change to closely conform to the roll circumference so as to engage same with at most a very narrow gap as described in the above-cited German patent document. Thus the air fed under pressure from the source 26 will create an air cushion that will carry at least part of the load of the roll 2, transmitting it to the rigid beam 13. This relieves the holders 5 of this stress so they do not have to be built to support very heavy loads, and also relieves the roller 3 so that same will not bend.

At the start of winding no air-cushion pressure relief is needed. In fact the rolls 2 each need to be held down by the respective rollers 11 to ensure sufficient friction to drive them. During such operation the beam 13 is in a lowermost position, flush with the floor, and the machine is readily accessible from both sides. While in this bottom position the carriages 16 can be shifted axially to align with the rolls 2, it being noted that as shown in FIG. 1 a particularly long roll 2 can be held by two boxes 18.

As the roll size increases the beams 13 are lifted to position the axes 20 immediately adjacent the roller 3, in the nip defined by same and the respective roll 2. This is an intermediate position.

Once the rolls reach a certain size, normally about 1000 mm in diameter, the actuators 19 pivot the boxes 18 inward to engage snugly around the respective rolls 2 and air is fed to them to pick up some of the load. As roll diameter increases, the cylinders 19 relax to allow the boxes 18 to push back, following the increasing roll size. Much of the weight of the rolls 2 is thus borne by the beams 13 rather than by the holders 5 or the roller 3.

Once the rolls are finished the drive 24 is stopped and the strips cut. Then the actuators 19 are relaxed to drop the boxes away from the rolls 2 and the carriages 16 are displaced axially to move the boxes 18 to positions between adjacent rolls 2. Then the actuator 25 moves the beams 13 into an uppermost position in which they directly engage all the rolls 2 of the respective row. The weight of the rolls 2 is thus taken up by the beams 13 and the holders 5 are moved axially away from the respective rolls 2, completely releasing them. Then the beams 13 drop back down to lower the complete rolls 2 down to floor level where they can be picked up and carted off.

We claim:

1. An apparatus for making a plurality of relatively narrow rolls of paper from a relatively wide strip of paper, the apparatus comprising:

a relatively wide main roller rotatable about and centered on a main axis;

means for longitudinally slitting the wide paper strip into relatively narrow strips of papers and for feeding same to the main roller with the strips axially closely juxtaposed;

a plurality of pairs of support heads arranged in two rows extending along the main roller with the rows spaced angularly from each other relative to the main axis, each pair of support heads being spaced in the respective row axially from the other support heads of the respective row and each pair of support heads being adapted to engage in an end of a roll core about which a respective one of the strips is wound;

drive means for rotating the main roller and thereby winding the strips up on the respective roll cores;

two respective beams extending axially along the main roller underneath the respective rows of support heads substantially the full length of the main roller;

means for raising and lowering the beams;

respective guides extending along each of the beams substantially the full length of the main roller;

respective carriages associated with the holder pairs and travelable along the guides of the respective beams;

a respective blower box on each of the carriages having an upwardly open mouth snugly engageable with the roll held in the respective pair of holders;

means for raising and lowering each blower box relative to the respective carriage and thereby fitting the respective mouth to the respective roll; and means for ejecting air from the mouths of the blower boxes and thereby at least partially supporting the respective rolls via respective air cushions on the respective blower boxes.

2. The roll-making apparatus defined in claim 1 wherein each of the blower boxes is pivotal on the respective carriage about an axis extending parallel to the main axis.

3. The roll-making apparatus defined in claim 2 wherein the blower-box axes are closely radially juxtaposed with the main roller.

4. The roll-making apparatus defined in claim 1 wherein the guides are tracks extending along the respective beams.

5. A method of operating an apparatus for making a plurality of relatively narrow rolls of paper from a relatively wide strip of paper, the apparatus comprising:

a relatively wide main roller rotatable about and centered on a main axis;

a plurality of pairs of support heads arranged in two rows extending along the main roller with the rows spaced angularly from each other relative to the main axis, each pair of support heads being spaced in the respective row axially from the other support heads of the respective row and each pair of support heads being adapted to engage in an end of a roll core about which a respective narrow strip is wound;

two respective beams extending axially along the main roller underneath the respective rows of support heads substantially the full length of the main roller;

respective guides extending along each of the beams substantially the full length of the main roller;

respective carriages associated with the holder pairs and travelable along the guides of the respective beams; and a respective blower box on each of the carriages having an upwardly open mouth snugly engageable with the roll held in the respective pair of holders, the method comprising the steps of forming the relatively narrow rolls by longitudinally slitting the wide paper strip into relatively narrow strips of papers and feeding same to the main roller with the strips axially closely juxtaposed;

rotating the main roller and thereby winding the strips up on the respective roll cores;

raising each blower box relative to the respective carriage and thereby fitting the respective mouth to the respective roll;

ejecting air from the mouths of the blower boxes and thereby at least partially supporting the respective rolls via respective air cushions on the respective blower boxes;

when each narrow roll is complete, unloading same by lowering each blower box relative to the respective carriage and thereby disengaging the respective mouths from the respective rolls;

displacing each blower box axially into a position out from beneath any of the rolls;

raising the beams to engage same against the rolls;

releasing each of the rolls from the respective holder pair; and lowering the beams to drop the rolls out from between the respective holder pairs.

* * * * *